US009549268B2

(12) United States Patent
Barthel et al.

(10) Patent No.: US 9,549,268 B2
(45) **Date of Patent: *Jan. 17, 2017**

(54) METHOD AND HEARING DEVICE FOR TUNING A HEARING AID FROM RECORDED DATA

(75) Inventors: Roland Barthel, Erlangen (DE); Andre Steinbuss, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 2081 days.

This patent is subject to a terminal disclaimer.

(21) Appl. No.: 12/684,148

(22) Filed: Jan. 8, 2010

(65) Prior Publication Data

US 2010/0195839 A1 Aug. 5, 2010

(30) Foreign Application Priority Data

Feb. 2, 2009 (DE) ..... 10 2009 007 074

(51) Int. Cl.
*H04R 29/00* (2006.01)
*H04R 25/00* (2006.01)

(52) U.S. Cl.
CPC ..... *H04R 25/70* (2013.01); *H04R 25/505* (2013.01); *H04R 2225/39* (2013.01); *H04R 2225/41* (2013.01)

(58) Field of Classification Search
USPC ..... 381/23.1, 60, 312, 314, 315
See application file for complete search history.

(56) References Cited

U.S. PATENT DOCUMENTS 4,972,487 A 11/1990 Mangold et al.
6,035,050 A * 3/2000 Weinfurtner et al. ..... 381/313
7,853,028 B2 * 12/2010 Fischer ..... 381/312
8,059,847 B2 * 11/2011 Nordahn ..... 381/328
2004/0131195 A1 7/2004 Mergell
2005/0105750 A1 5/2005 Frohlich et al.
2006/0222194 A1 10/2006 Bramslow et al.
2007/0009126 A1 1/2007 Fischer
2007/0223753 A1 9/2007 Latzel
2008/0107296 A1 5/2008 Bachler et al.
2010/0080398 A1 * 4/2010 Waldmann ..... 381/66

FOREIGN PATENT DOCUMENTS

DE 102 45 567 B3 4/2004
DE 103 47 211 A1 5/2005
DE 10 2008 019 898 A1 10/2009
EP 1845751 A1 10/2007

* cited by examiner

*Primary Examiner* — Duc Nguyen
*Assistant Examiner* — Phan Le
(74) *Attorney, Agent, or Firm* — Laurence A. Greenberg; Werner H. Stemer; Ralph E. Locher

(57) ABSTRACT

A hearing device and an associated method for tuning a hearing aid include at least one hearing aid and at least one external unit. The device includes the following: a memory unit in the hearing aid which stores the times and the listening situations for which at least one predefinable algorithm for signal processing is activated; an output unit in the hearing aid and/or in the external unit which outputs and/or displays the stored times, listening situations and the activated algorithm; an input unit in the hearing aid or in the external unit for inputting an assessment rating which expresses the hearing aid wearer's satisfaction with the algorithm activated, and a change unit in the hearing aid for changing at least one parameter of the algorithm as a function of the assessment rating. Even algorithms of very short duration, such as an MPO, for example, are trainable.

13 Claims, 2 Drawing Sheets

METHOD AND HEARING DEVICE FOR TUNING A HEARING AID FROM RECORDED DATA

CROSS-REFERENCE TO RELATED APPLICATION

This application claims the priority, under 35 U.S.C. §119, of German application DE 10 2009 007 074.5, filed Feb. 2, 2009; the prior application is herewith incorporated by reference in its entirety.

BACKGROUND OF THE INVENTION

Field of the Invention

The invention relates to a method for tuning a hearing aid and to a hearing device formed with a hearing aid and an external unit for tuning the hearing aid.

The tuning of hearing aids, particularly with regard to gain and compression, is nowadays achieved in many cases by adaptive fitting algorithms based on audiometric data. The audiometric data taken into account include hearing loss, uncomfortable loudness level, volume scaling and the like. The fitting formulas are based on statistical and empirical knowledge and are therefore only of limited validity for the individual hearing aid user. Time-consuming follow-up support from the hearing aid audiologist is necessary, particularly for the optimum setting of the frequency-dependent and level-dependent gain. Another problem is that the optimum setting of the user's hearing aid can only be found and verified in realistic acoustic situations that are relevant for the user.

An individual, optimum setting has hitherto been iteratively achieved over repeated visits to the hearing aid audiologist. However, as certain acoustic situations can only be inadequately conveyed to the audiologist, the setting arrived at in this way often turns out to be less suitable on return to real-life situations. It is precisely the typical spatial sound field frequently encountered by the user or the individual requirements of the hearing aid user that cannot be recreated or more especially taken into account in artificial acoustic situations.

It is therefore important, when tuning a hearing aid, to be able to address individual requirements more selectively.

Modern digital hearing aids therefore have learning algorithms with the aid of which personal hearing aid settings can be learned. The hearing aid user adjusts many different values of the hearing aid settings either over a time-limited learning period or continuously over the lifetime of his hearing aid. However, not all these settings are of the same importance to the hearing aid user. Some of these settings are quickly canceled. Once the hearing aid user has found settings which are well suited to the listening situation, he will leave these settings unchanged until such time as the hearing aid situation changes. For a learning algorithm, all the user settings are initially of equal importance. Therefore, the satisfaction with a particular setting must also be taken into account in some way.

There are two approaches here: time-based learning and event-based learning. With time-based learning, hearing aid settings which are used for a comparatively long period of time are given more weight than those of shorter duration. A disadvantage of time-based learning is its limited usability for level-dependent learning. With level-dependent learning it is important that a learning step also takes account of the current level. Therefore, there is also what is known as event-based learning whereby a learning step is carried out whenever the hearing aid user makes a change to his device, e.g. to the gain.

However, the limitation of event-based learning is that the importance of a training step is independent of the time within which a setting remains active. In other words, if the hearing aid user maintains a change over a long period, this change is no more heavily weighted than a change for a shorter period.

Reference is had, in this context, to a commonly assigned patent application, which was published after the priority date of the instant application, namely, DE 10 2008 019 898 A1. There, there is specified a method for overcoming the disadvantages described. A desired set value is input to the hearing aid at a freely selectable time, at least one sound variable relating to an ambient situation is measured at a freely selectable time, a period of time is determined within which the desired set value has not been changed, and the set values to be used—as a function of the desired set value, the at least one sound variable measured at the freely selectable point in time and the time period determined—are learned.

However, the described scope of learning is limited to algorithms which the hearing aid wearer can implement "in vivo" via a control such as a volume wheel or a remote control, for example. Other algorithms which are equally conducive to tone and wear comfort are not learned. For example, a limiting of the maximum power output (MPO) cannot be learned using the known methods. The MPO generally is effective for very loud, short, transient signals and is therefore extremely difficult to learn "in vivo". Other examples are suppression methods for impulse noise or the suppression of feedback. The situations in which the algorithm is effective are too short to react within the situation and train the hearing aid.

SUMMARY OF THE INVENTION

It is accordingly an object of the invention to provide a method and a hearing aid device for adjusting a hearing aid with recorded data which overcome the above-mentioned disadvantages of the heretofore-known devices and methods of this general type and which provides for method and an associated hearing device which makes adjustment of algorithms learnable or, more precisely, trainable even for only brief listening situations.

With the foregoing and other objects in view there is provided, in accordance with the invention, a method of tuning a hearing aid, the method which comprises the following steps:

wearing the hearing aid by a hearing aid user;

storing times and listening situations in the hearing aid for which at least one predefined signal processing algorithm is activated;

switching the hearing aid to learning mode;

outputting (e.g., audible output and/or visual output) the stored times and listening situations and the respective signal processing algorithm that was activated;

inputting an assessment rating representing the hearing aid wearer's satisfaction with the signal processing algorithm that was activated; and changing of at least one parameter of the algorithm as a function of the assessment rating.

This has the advantage that algorithms of only short duration, such as an MPO, for example, are trainable. These cannot even be reproduced via suitable controls on the hearing aid or a hearing aid remote control.

In another embodiment, the listening situation can be identified and described by situation recognition and/or at least one level measurement and/or at least one algorithm.

In a development of the invention, a hearing aid remote control can be used for output and/or display and the inputting of the assessment rating, thereby enabling the stored listening situations to be interrogated in a simple manner.

In accordance with yet another embodiment, a personal computer can be used for output and/or display and the inputting of the assessment rating. This offers the advantage of ease of operation.

In addition, audible output can be provided by the hearing aid, thereby facilitating operation.

In another embodiment, the storage and output can include recordings of microphone signals of the hearing aid. The advantage of this is that the hearing aid user can easily recognize the listening situation again.

With the above and other objects in view there is also provided, in accordance with the invention, a hearing device assembly for hearing aid adjustment, comprising:

at least one hearing aid and at least one external unit;

a memory unit in said hearing aid, said memory unit storing times and listening situations for which at least one predefinable signal processing algorithm is activated;

an output unit in at least one of said hearing aid and said external unit for outputting and/or displaying the times, the listening situations, and the signal processing algorithm respectively activated and stored in said memory unit;

an input unit in at least one of said hearing aid and said external unit for inputting an assessment rating representing a hearing aid wearer's satisfaction with the algorithm activated; and a change unit in said hearing aid for changing at least one parameter of the algorithm as a function of the assessment rating.

The primary advantage of this is that algorithms which are only applied briefly are also trainable.

The device can advantageously incorporate a situation recognition unit and/or at least one level meter. The latter identify and determine the listening situation.

In accordance with an added feature of the invention, the external unit can be a remote control or a personal computer.

In accordance with an additional feature of the invention, the output unit can incorporate a display unit.

The memory unit can additionally store recordings of hearing aid microphone signals.

In addition, the output unit can output the stored recordings of hearing aid microphone signals.

Other features which are considered as characteristic for the invention are set forth in the appended claims.

Although the invention is illustrated and described herein as embodied in a method and hearing device for tuning a hearing aid from recorded data, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
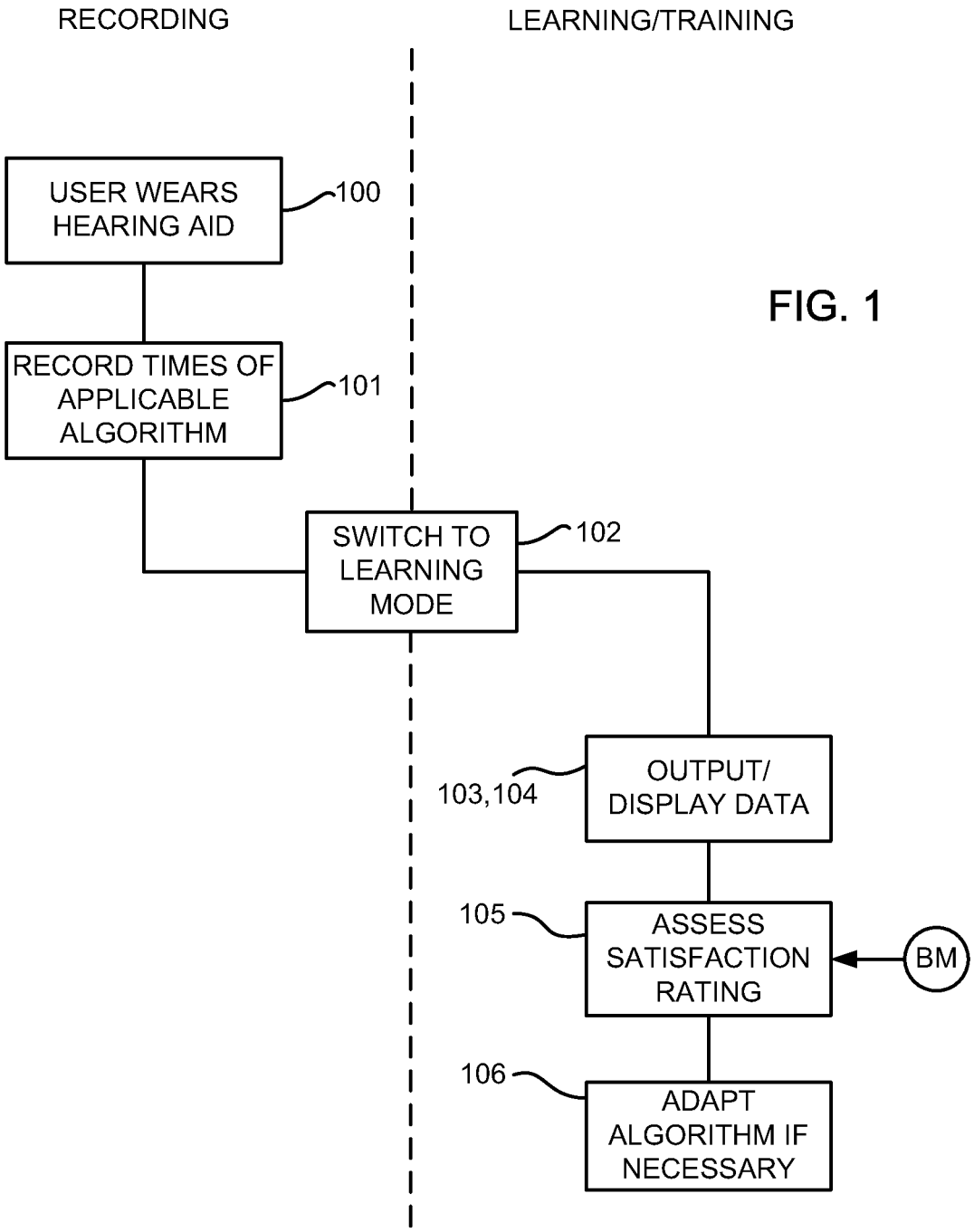
FIG. 1 shows a flowchart illustrating a method according to the invention.

Referring now to the figures of the drawing in detail and first, particularly, to FIG. 1 thereof, there is shown a flow chart of an inventive method for tuning a hearing aid. In a first step 100, a hearing aid user wears the hearing aid whose parameters are to be adjusted. In step 101, the hearing aid stores the times and listening situations where at least one predefinable hearing aid signal processing algorithm is activated.

In the subsequent step 102, the hearing aid is switched over to a learning mode. This can be done by the hearing aid wearer in the evening, for example, preferably via a remote control. Then, in steps 103 and 104, the recorded data are output and/or displayed. For the outputting and/or display of the data relating to the acoustic situation, among other things the events of the hearing aid's own situation recognition unit or even different level meters can be used to characterize the acoustic situation in a more representative manner based on said data. The data are preferably output audibly via the hearing aid itself. They can also be displayed and output on the remote control or a personal computer. The output can also comprise a brief verbal or textual characterization of the listening situation, such as "loud knocking" or "bang". Recordings of the microphone signal can also be played. This is used to better remind the hearing aid wearer of the listening situation. In the next step 105 the hearing aid wearer makes an assessment of satisfaction with the setting of the algorithm for the specific listening situation. For this purpose an assessment rating BM is input to the remote control or the personal computer. The remote control or the personal computer offer the hearing aid wearer various selection options for the assessment. The simplest assessment consists of three gradations: "too loud", "correct" and "too quiet".

In the final step 106, one or more parameters of the algorithm selected and displayed are changed according to the assessment rating BM. In the event of a "correct" assessment, no change is effected.

A suitable example of learning is the algorithm for limiting the maximum output level, or MPO for short. The MPO is generally effective for very loud, short, transient signals. The hearing aid stores, for example, the fact that in the course of a day the MPO was triggered once in a loud environment at 15:00 in channels 1 and 2. The hearing aid wearer then has the possibility of assessing post-hoc whether he was satisfied with the hearing aid in this situation. If the device was too loud, the hearing aid is trained such that the MPO in channels 1 and 2 is reduced by one level.

Figure 2:
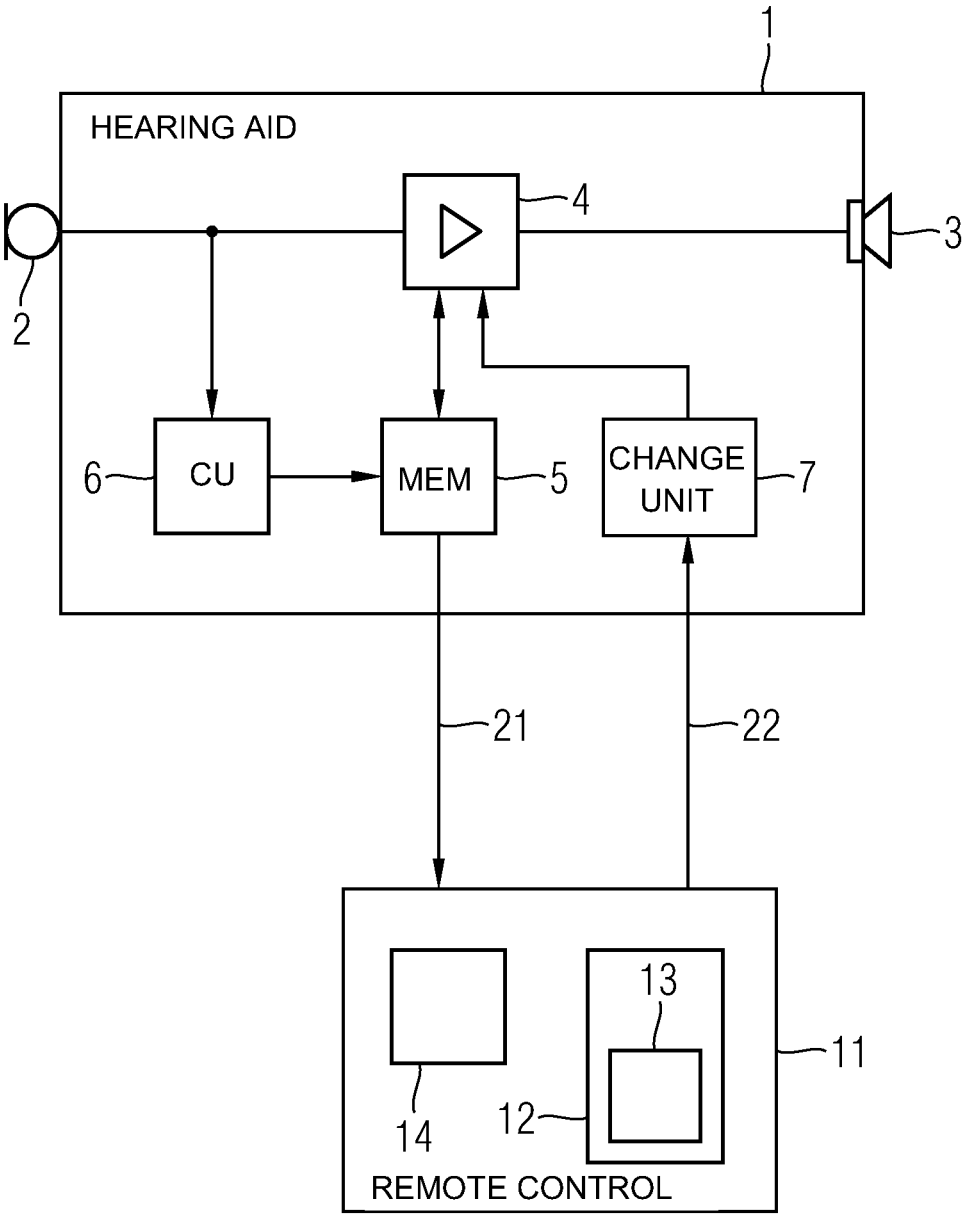
FIG. 2 shows a block diagram of a hearing device according to the invention.

Referring now to FIG. 2, there is shown a block diagram of a hearing device according to the invention, comprising a hearing aid 1 and a remote control 11. The hearing aid incorporates a microphone 2 for picking up ambient sound and converting it into an electrical signal, a signal processing unit 4 which is connected to the microphone 2 and digitizes, modifies and amplifies the electrical signal and converts it back into an analog signal which is finally fed out via a receiver 3 to the hearing aid wearer's ear drum as an amplified and modified acoustic signal.

To implement the method according to the invention, the hearing aid 1 also has a classification unit 6 which is connected to the output of the microphone 2 and classifies every listening situation, and a memory unit 5 which is connected to the classification unit (CU) 6 and the signal processing unit 4 and which records or more precisely stores the algorithms selected by the signal processing unit 4 as well as the associated listening situations and time stamps. The parameters of the algorithms of the signal processing unit 4 can be changed if required with the aid of a change unit 7 in the hearing aid 1.

The remote control 11 is used to switch the hearing aid 1 to a training mode in which the stored listening situations with the associated algorithms are retrieved from the memory unit 5 of the hearing aid and can be displayed on an output unit 12 incorporating a display unit 13. The display unit 12 enables the hearing aid user to remember the listening situation with the associated algorithms. The hearing aid user is thus able to assess the listening situation and the associated reaction of the hearing aid 1 and communicate this assessment to the hearing aid 1 via an input unit 14 of the remote control 11. According to the assessment, the change unit 7 changes one or more parameters of the algorithm responding in the particular listening situation. The remote control 11 and the interactive dialog implemented therein therefore enable the hearing aid wearer to train the hearing aid 1 in the evening, for example. Communication between the hearing aid 1 and the remote control 11 is via wireless data transmission links 21, 22.

The invention claimed is:

1. A method of tuning a hearing aid, the method which comprises the following steps:

wearing the hearing aid by a hearing aid user;

while the hearing aid is being worn by the hearing aid user and the hearing aid is in an operational mode, storing times and listening situations in the hearing aid for which at least one predefined signal processing algorithm is activated;

subsequently switching the hearing aid to learning mode;

outputting the stored times and listening situations and the respective signal processing algorithm that was activated while the hearing aid was in the operational mode;

inputting an assessment rating representing the hearing aid wearer's satisfaction with the signal processing algorithm that was activated while the hearing aid was in the operational mode; and changing at least one parameter of the algorithm as a function of the assessment rating.

2. The method according to claim 1, which comprises identifying and describing the listening situation by at least one of the following: a situation recognition, at least one level measurement, and at least one algorithm.

3. The method according to claim 1, wherein the outputting step comprises audibly outputting the information and/or visually displaying the information.

4. The method according to claim 1, which comprises performing the outputting step and inputting the assessment rating with a hearing aid remote control.

5. The method according to claim 1, comprises performing the outputting step and inputting the assessment rating via a personal computer.

6. The method according to claim 1, which comprises providing audible output with the hearing aid.

7. The method according to claim 1, wherein the storing and outputting steps comprise replaying recordings of hearing aid microphone signals.

8. A hearing device assembly for hearing aid adjustment, comprising:

at least one hearing aid and at least one external unit;

a memory unit in said hearing aid, said memory unit , while said hearing aid is disconnected from said at least one external unit, storing times and listening situations for which at least one predefinable signal processing algorithm is activated;

an output unit in at least one of said hearing aid and said external unit for outputting and/or displaying the times, the listening situations, and the signal processing algorithm respectively activated and stored in said memory unit;

an input unit in at least one of said hearing aid and said external unit for inputting an assessment rating representing a hearing aid wearer's satisfaction with the algorithm activated; and a change unit in said hearing aid for changing at least one parameter of the algorithm as a function of the assessment rating.

9. The hearing device according to claim 8, which further comprises a situation recognition unit and/or at least one level meter configured to detect and determine the listening situation.

10. The hearing device according to claim 8, wherein said external unit is a remote control or a personal computer.

11. The hearing device according to claim 8, wherein said output unit comprises a display unit.

12. The hearing device according to claim 8, wherein said memory unit stores recordings of hearing aid microphone signals.

13. The hearing device according to claim 12, wherein said output unit outputs the stored recordings of hearing aid microphone signals.

* * * * *